United States Patent [19]

Levy

[11] 4,011,444

[45] Mar. 8, 1977

[54] LAMP ASSEMBLY

[75] Inventor: George D. Levy, Wellesley Hills, Mass.

[73] Assignee: ACLA, Inc., Boston, Mass.

[22] Filed: Oct. 31, 1975

[21] Appl. No.: 627,545

[52] U.S. Cl. ..... 240/10 A

[51] Int. Cl.[2] ..... A47G 33/16; F21P 1/02

[58] Field of Search ..... 240/10 A, 10 B, 10 T, 240/10 R

[56] References Cited

UNITED STATES PATENTS

| | | | |
|---|---|---|---|
| 2,248,117 | 7/1941 | Petry | 240/10 T |
| 2,383,941 | 9/1945 | Otis | 240/10 A X |
| 2,569,078 | 9/1951 | Silver et al. | 240/10 A X |
| 2,741,693 | 4/1956 | Fasson | 240/10 A X |
| 2,797,310 | 6/1957 | Moore | 240/10 R X |
| 2,530,794 | 11/1950 | Tiscione | 240/10 A X |

*Primary Examiner*—John Gonzales
*Attorney, Agent, or Firm*—Wolf, Greenfield & Sacks

[57] ABSTRACT

The device is preferably for use as a Christmas candle lamp including an enclosed liquid column in the form of a hollow glass candle, a standard incandescent bulb and a separable housing having opposite end for receiving the column and bulb and supporting the bulb in contact with the column to cause heating and subsequent bubbling of the liquid in the column. The housing is made in two parts that are snap-fitted and can be separated for the purpose of replacing the bulb when it has burnt out.

1 Claim, 3 Drawing Figures

LAMP ASSEMBLY

BACKGROUND OF THE INVENTION

The present invention pertains in general to a lamp assembly and is more particularly concerned with an improved construction of a Christmas candle lamp which permits the replacement of the bulb of the lamp assembly.

There are presently sold Christmas candle lamps which comprise a candle shaped tube filled with liquid which is held in a housing in contact with a standard incandescent lamp. Both the tube and bulb are glued into the housing and when the device is inserted into an electrical socket the bulb illuminates the column and the heat from the bulb causes the liquid in the tube to bubble providing a flickering candle effect. The problem with the existing device is that when the bulb burns out then the entire assembly has to be discarded as all of the components are tightly sealed together by glue in a permanent fashion.

Accordingly, one object of the present invention is to provide a candle lamp assembly which may be readily disassembled to permit replacement of the lamp.

Another object of the present invention is to provide an improved candle lamp assembly comprising parts that may be easily snap-fitted together and easily disassembled for purpose of replacing the bulb within the assembly.

SUMMARY OF THE INVENTION

To accomplish the foregoing and other objects of this invention, the lamp assembly generally comprises a tube filled with a quantity of liquid, an incandescent bulb which is preferably a conventional bulb having an illuminating glass end and a metal connecting end, a housing for holding both the tube and bulb, and means associated with the housing for separably holding the two parts of the housing together in an unpermanent fashion so that the parts can be separated for the purpose of replacing the bulb. The tube is in the form of a candle which is completely enclosed to prevent the liquid from escaping. The liquid fills preferably less than the entire space in the tube and is preferably colored. When heat is applied to one end of the tube, the tube contains a substance in addition to the liquid which causes bubbles to rise in the tube. The heat is applied from the incandescent bulb which preferably contacts the tube or may be spaced a slight distance from the tube. The housing includes two separable parts defining a chamber having a passage in one part for accommodating the tube with the tube extending partially into the chamber. The other part also has a passage in alignment with the passage in the one part when the parts are assembled. This passage accommodates the bulb with the illuminating end disposed in the chamber in juxtaposition to the end of the tube. The connecting end of the bulb extends outwardly from the housing for connection into an electrical socket. The device of this invention may be used in a candelabra assembly or could be used individually on a Christmas tree.

BRIEF DESCRIPTION OF THE DRAWINGS

Numerous other objects, features and advantages of the invention should now become apparent upon a reading of the following detailed description taken in conjunction with the accompanying drawing, in which.

DETAILED DESCRIPTION

Figure 1:
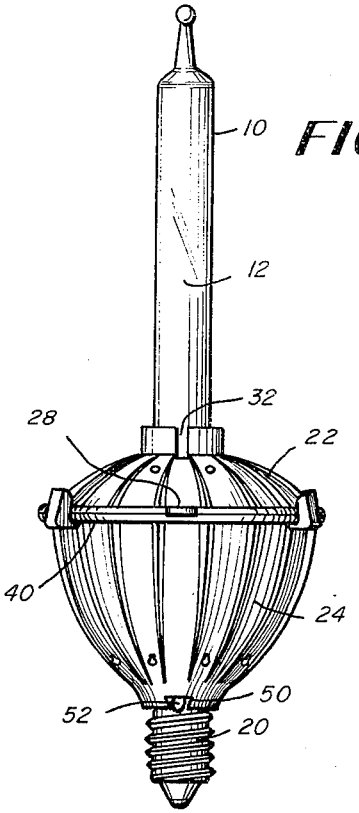
FIG. 1 is an elevational view of a device constructed in accordance with the principles of this invention.
Figure 2:
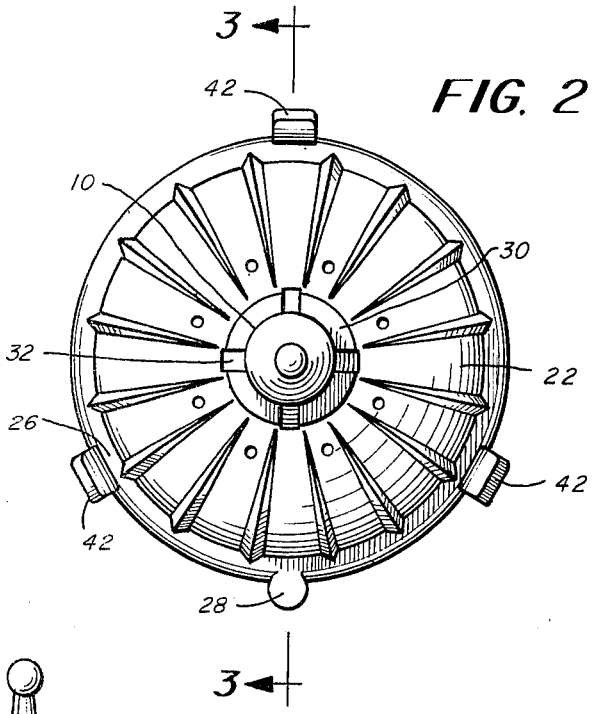
FIG. 2 is a bottom view of the device shown in FIG. 1.

Referring now to the drawings, there is shown the cylindrical tube 10 which is constructed of glass in the form of a candle and contains preferably a colored liquid 12. The liquid 12 fills the majority of the tube but has a volume less than the total volume in the tube. The tube is essentially of conventional design and has a substance 14 at the bottom thereof which chemically reacts when heat is applied thereto causing bubbles to rise in the liquid 12 within the tube 10.

The heat is applied to the tube from the bulb 16 which comprises an illuminating end 18 and a connecting end 20. The bulb is itself of conventional design and in FIG. 3 the bulb is shown in contact with the bottom end of the tube 10. This contact is preferred but the bubbling action also occurs when there is a space between the illuminating end 18 and the bottom surface of the tube 10. The connecting end 20 of the bulb 18 has a conventional screw thread for threading into an electrical socket.

Figure 3:
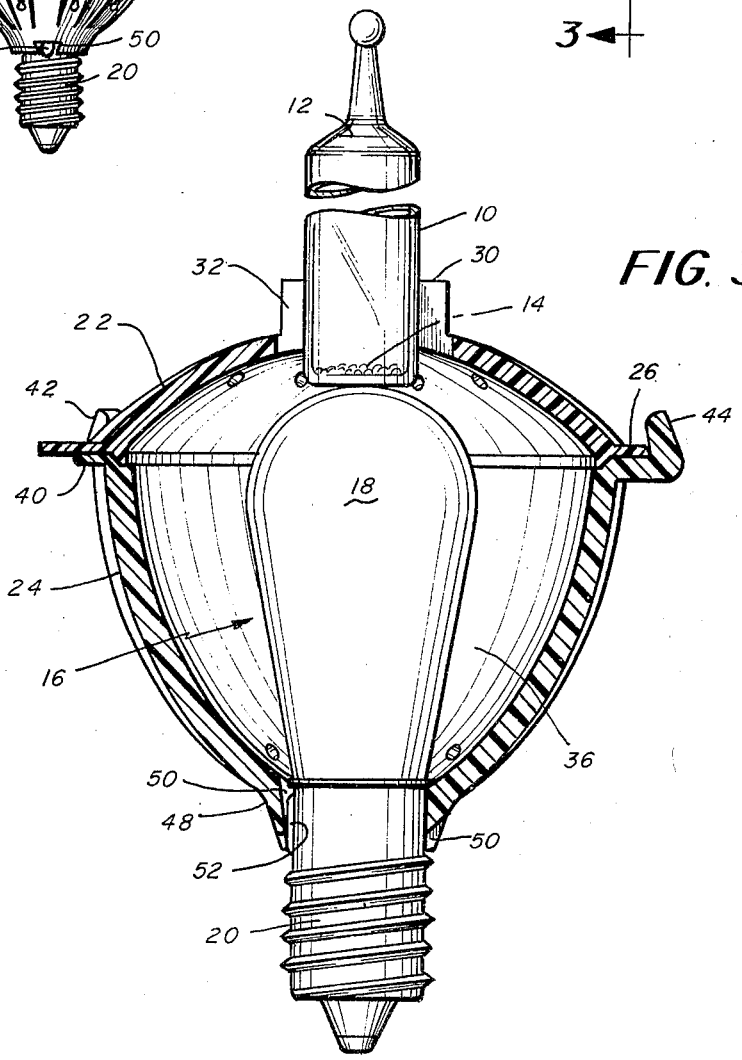
FIG. 3 is a cross-sectional view taken along line 3—3 of FIG. 2.

Both the bulb and the tubes are held in place by means of a housing which comprises a housing part 22 and a housing part 24 which snap-fit together in the disclosed embodiment. Both of these parts are substantially semi-spherical and the part 22 includes an annular ridge 26. A tab 28 extends from this ridge and is used for the purpose of separating the two parts 22 and 24. The part 22 also has a centrally disposed collar 30 at the top thereof defining a passage for accommodating the tube 10. The collar 30 may be provided with slots 32 which provide some give to the collar for permitting easy insertion of the tube 10 into the collar. The tube may be force fitted into the collar and is preferably glued in place although the gluing is not absolutely necessary. FIG. 3 shows the tube extending into the chamber 36 defined by the parts 22 and 24 a slight distance below the collar 30.

The housing part 24 likewise has an annular flange 40 having the flange 26 overlying the flange 40. A plurality of ears 42 extend from the flange 40. Each of these ears includes an upright wall 44 which is slightly tapered. In this way the part 22 can be inserted into two of the ears 42 and then snap-fitted against the slanted surface of the third wall 44 to snap-fit the two parts together. The tab 28 is used as a means for separating the two parts. The tab 28 is preferably located fairly close to one of the ears 42 so that it is quite easy with a finger and thumb to separate the two parts.

The bulb 16 can rotate freely within the part 24. If the bulb does rotate relative to the part 24 then the bulb and part 24 can be connected into an electrical socket before the two parts are assembled. Then it is just a case of assembling the part 22 to the part 24 seeing that the tube 10 is in the proper position relative to the bulb.

On the other hand, and as shown in FIG. 3, the part 24 is provided with a slight tapered bottom collar 48 which has a pair of diametrically disposed slots 50. The bulb 16 is usually provided with a solder spot 52 which can fit into one of the slots 50 for preventing relative rotation between the bulb and housing. In still another arrangement the opening defined by the collar 48 for receiving the bulb may be properly dimensioned so that there is a force fit or tensioned pressure fit between the housing part 24 and the section 20 of the bulb. In this way the bulb does not rotate relative to the housing.

Having described one embodiment of the present invention, it is apparent to those skilled in the art that numerous other embodiments and modifications of the one shown herein are contemplated as falling within the spirit and scope of the present invention. For example, a particular arrangement has been shown for securing the housing parts together. In another embodiment rather than providing a snap-fit one could provide a screw-fit between the two parts.

What is claimed is:

1. A lamp assembly comprising, in combination:

a transparent tube in the form of a candle completely enclosed and for holding a quantity of liquid filling less than the total space in the tube and which generates bubbles in the tube when heat is applied at one end of the tube, an incandescent bulb having an illuminating end and a threaded connecting end, a housing for holding both the tube and bulb including two separable housing parts defining a chamber joining along a circular locus and having a passage in one part defined by a slotted collar for accommodating the tube with the tube extending partially into the chamber and a passage in the other part defined by a collar integral with the other part and in line with the passage in the one part when the parts are assembled for accommodating the bulb with the illuminating end disposed in the chamber in juxtaposition to the one end of the tube and the connecting end extending outwardly from the housing for connection to an electrical socket, said collar of said other part having at least one slot for receiving a solder spot on the connecting end of the bulb to prevent rotation of the bulb relative to the other housing part, means associated with the housing for separably holding the two parts together in an unpermanent manner so that the parts can be separated for the purpose of replacing the bulb comprising three equally spaced ears extending from an annular flange of the other housing and a like annular flange of said one housing fitting within the ears to hold the parts together, said annular flanges having flat mutual contacting surfaces, and means for separating the housing parts including a tab integral with and extending from the annular flange of the one part and disposed between a pair of the three ears.

* * * * *